US008899191B2

(12) United States Patent
Yano et al.

(10) Patent No.: US 8,899,191 B2
(45) Date of Patent: Dec. 2, 2014

(54) COOLING APPARATUS OF ENGINE

(75) Inventors: Takahiro Yano, Kakogawa (JP); Michio Hirano, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 316 days.

(21) Appl. No.: 13/316,928

(22) Filed: Dec. 12, 2011

(65) Prior Publication Data

US 2012/0160194 A1 Jun. 28, 2012

(30) Foreign Application Priority Data

Dec. 24, 2010 (JP) ..... P2010-288581

(51) Int. Cl.

| | |
|---|---|
| ***F01P 7/04*** | (2006.01) |
| ***F02F 1/34*** | (2006.01) |
| ***F01P 1/02*** | (2006.01) |
| *F01P 11/12* | (2006.01) |
| *F01P 5/06* | (2006.01) |
| *F01P 5/02* | (2006.01) |
| *F02B 63/02* | (2006.01) |

(52) U.S. Cl.

CPC ... *F02F 1/34* (2013.01); *F01P 1/02* (2013.01); *F01P 11/12* (2013.01); *F01P 5/06* (2013.01); *F01P 5/02* (2013.01); *F02B 63/02* (2013.01); *F01P 2001/026* (2013.01)

USPC ..... 123/41.65

(58) Field of Classification Search

CPC ..... F01P 5/06; F01P 1/02; F01P 5/02; F01P 11/12; F02B 63/02

USPC ..... 123/41.65

See application file for complete search history.

(56) References Cited

U.S. PATENT DOCUMENTS

| | | | | |
|---|---|---|---|---|
| 4,982,705 | A * | 1/1991 | Hudson | 123/41.65 |
| 2008/0105220 | A1 | 5/2008 | Shiota et al. | |
| 2009/0301413 | A1 * | 12/2009 | Ogawa et al. | 123/41.48 |

FOREIGN PATENT DOCUMENTS

| | | |
|---|---|---|
| CN | 101265831 A | 9/2008 |
| CN | 1989322 B | 5/2010 |
| JP | 58-118215 | 8/1983 |
| JP | 02-50021 | 4/1990 |
| JP | 02-124219 | 10/1990 |
| JP | 6-42347 | 2/1994 |
| JP | 2001-241355 | 9/2001 |

* cited by examiner

*Primary Examiner* — Lindsay Low
*Assistant Examiner* — Charles Brauch
(74) *Attorney, Agent, or Firm* — Wenderoth, Lind & Ponack, LLP

(57) ABSTRACT

A cooling apparatus of an engine includes a cooling fan, a fan housing, and a shroud guiding cooling air from the fan housing to the outer circumferential surface of an engine body portion. Further, a cooling air passage passing throughout in a cylinder head from one side surface of the cylinder head to the other side surface thereof is formed in the cylinder head, and a narrowed or throttle guide portion which guides the cooling air from the interior of the fan housing to an inlet opening of the one side surface of the cooling air passage is formed in the shroud.

6 Claims, 8 Drawing Sheets

COOLING APPARATUS OF ENGINE

BACKGROUND OF THE INVENTION

1. Field of the Invention

The present invention relates to a cooling apparatus of an air-cooled engine which includes a cooling fan fixed to a crankshaft and a fan housing surrounding the cooling fan.

2. Description of the Related Art

In order to cool a cylinder and a cylinder head of an air-cooled engine, typically, the air-cooled engine is equipped with a shroud covering the cylinder and the cylinder head. The shroud circulates cooling air delivered from the interior of a fan housing along the outer circumferential surfaces of the cylinder and the cylinder head. Japanese Patent Application Laid-Open (JP-A) No. 06-42347 discloses the above configuration.

In addition, in order to improve the cooling efficiency in the cylinder head, Japanese Patent Application Laid-Open (JP-A) No. 2001-241355 discloses the air-cooled engine which includes a cooling apparatus having a shroud and a cooling air passage passing into the cylinder head.

In the former conventional art, the cylinder and the cylinder head are cooled from only the outer circumferential surfaces thereof. Therefore, when an engine rotational speed is low so that the amount of the cooling air from a cooling fan is small, a portion or location to become hot in the cylinder head, e.g., the vicinity of an exhaust passage or a forming wall of a combustion chamber, cannot be cooled sufficiently.

In the latter conventional art, since the cooling apparatus has the cooling air passage in the cylinder head in addition to the shroud, the cooling effect in the vicinity of the exhaust passage in the cylinder head is improved. However, when the cooling air passage is simply formed in the cylinder head, it is difficult to supply a large amount of the cooling air to the cooling air passage. Thereby, the cooling air passage cannot be used efficiently. In the latter conventional art, the inlet area of the cooling air passage is increased to ensure the amount of the cooling air.

The present invention is related to a cooling apparatus cooling an engine body comprising of a cylinder and a cylinder head, and an object of the present invention is to provide the cooling apparatus of the engine which is capable of increasing the coolability of each location in the cylinder head and reducing the weight of the cylinder.

SUMMARY OF THE INVENTION

The present invention has been made to solve the above problems, and provides a cooling apparatus of an engine including a cooling fan fixed to one end of a crankshaft, a fan housing surrounding the cooling fan, a shroud guiding cooling air discharged from the interior of the fan housing to the outer circumferential surface of an engine body portion, a cooling air passage formed in a cylinder head composing the engine body portion and passing throughout in the cylinder head from one side surface of the cylinder head to the other side surface thereof, and a narrowed or throttle guide portion formed in the shroud and guiding the cooling air from the interior of the fan housing to an inlet opening of the one side surface of the cooling air passage.

In the above configuration, the present invention preferably adopts the following configurations.

(a) The cooling air passage is contacted with a forming wall of an exhaust passage in the cylinder head or passes near the forming wall.

(b) The cooling air passage supplies the cooling air flowing through the cooling air passage to an ignition plug.

(c) The cooling air passage is formed so as to pass through between a forming wall of a push rod insertion hole for intake valve and a forming wall of a push rod insertion hole for exhaust valve.

(d) The cooling air passage is formed in a substantially cross shape seen in a cylinder centerline direction. In this case, preferably, the cooling air passage formed in a substantially cross shape has three outlet openings, and one of the three outlet opens is opened in the same direction as the inlet of an intake passage.

the cooling air passage formed in a substantially cross shape has three outlet openings, one of the three outlet openings is opened in the same direction as the inlet of an intake passage, and the outlet opening is limited in the relief amount of the cooling air from the outlet opening by either or both of a gasket and an insulator arranged at the inlet of the intake passage.

(e) The shroud is spaced from the outer circumferential surface of the engine body portion in the upstream portion of the flow of the cooling air relative to the narrowed guide portion more largely than in the downstream portion of the flow of the cooling air. The narrowed guide portion is inclined so as to be close to the outer circumferential surface of the engine body portion toward the inlet opening of the cooling air passage.

(f) A cover portion which closes a space between the outer circumferential surface of the engine body portion and the shroud from above is formed at the upper end of the shroud.

(1) According to the present invention, the shroud flows the cooling air along the outer circumferential surface of the engine body portion to cool the engine body portion from the outer circumference thereof, of course, the cooling air flowing through the cooling air passage in the cylinder head can effectively cool each location in the cylinder head, and the narrowed guide portion formed in the shroud forcefully delivers the cooling air into the cooling air passage, so that the coolability of each location in the cylinder head can be further improved. In addition, the cooling air passage is formed, so that the weight of the cylinder head can be reduced.

(2) According to the configuration (a), the exhaust passage and its vicinity which are particularly likely to be hot in the cylinder head can be cooled locally, efficiently, and forcefully.

(3) According to the configuration (b), the ignition plug which is likely to be hot together with the exhaust passage can be cooled locally and efficiently by the cooling air.

(4) According to the configuration (c), the cooling air passage is formed so as to pass through between the forming wall of the push rod insertion hole for the intake valve and the forming wall of the push rod insertion hole for the exhaust valve, so that the waste space between the forming walls of the push rod insertion holes for the intake valve and the push rod insertion hole for the exhaust valve can be effectively used as the cooling air passage and that the cooling air passage can be easily formed at the time of casting the cylinder head.

(5) According to the configuration (d), the cooling air passage is formed in a substantially cross shape, so that the cooling air can be supplied over a wide range in the cylinder head to improve the coolability of the cylinder head and that further weight reduction can be achieved. In addition, the temperature increase is less in the vicinity of the intake passage than other locations, but the outlet opening in the vicinity of the intake passage is limited in the relief amount of the cooling air by either or both of the gasket and the insulator, so that the amount of the cooling air to other locations which are likely to be hot can be increased to further improve the cooling efficiency.

(6) According to the configuration (e), the narrowed guide portion can be formed by easy processing or working of forming the inclined surface in the shroud. That is, the cooling air can be efficiently delivered into the cooling air passage by the easy processing.

(7) According to the configuration (f), the cover portion at the upper end of the shroud can prevent the cooling air from being relieved upward from the interior of the shroud, so that the cooling effect of the cylinder body portion by means of the cooling air and the supply of the cooling air into the cooling air passage can be further increased.

BRIEF DESCRIPTION OF THE DRAWINGS

The above and other objects, features and advantages of the present invention will be become more apparent from the following description taken in connection with the accompanying drawings, in which.

DETAILED DESCRIPTION OF THE INVENTION

[First Embodiment]

FIGS. 1 to 10 show a single cylinder inclination type engine according to an embodiment of the present invention, and the embodiment of the present invention will be described with reference to these drawings.

(Configuration of Entire Engine)

Figure 1:
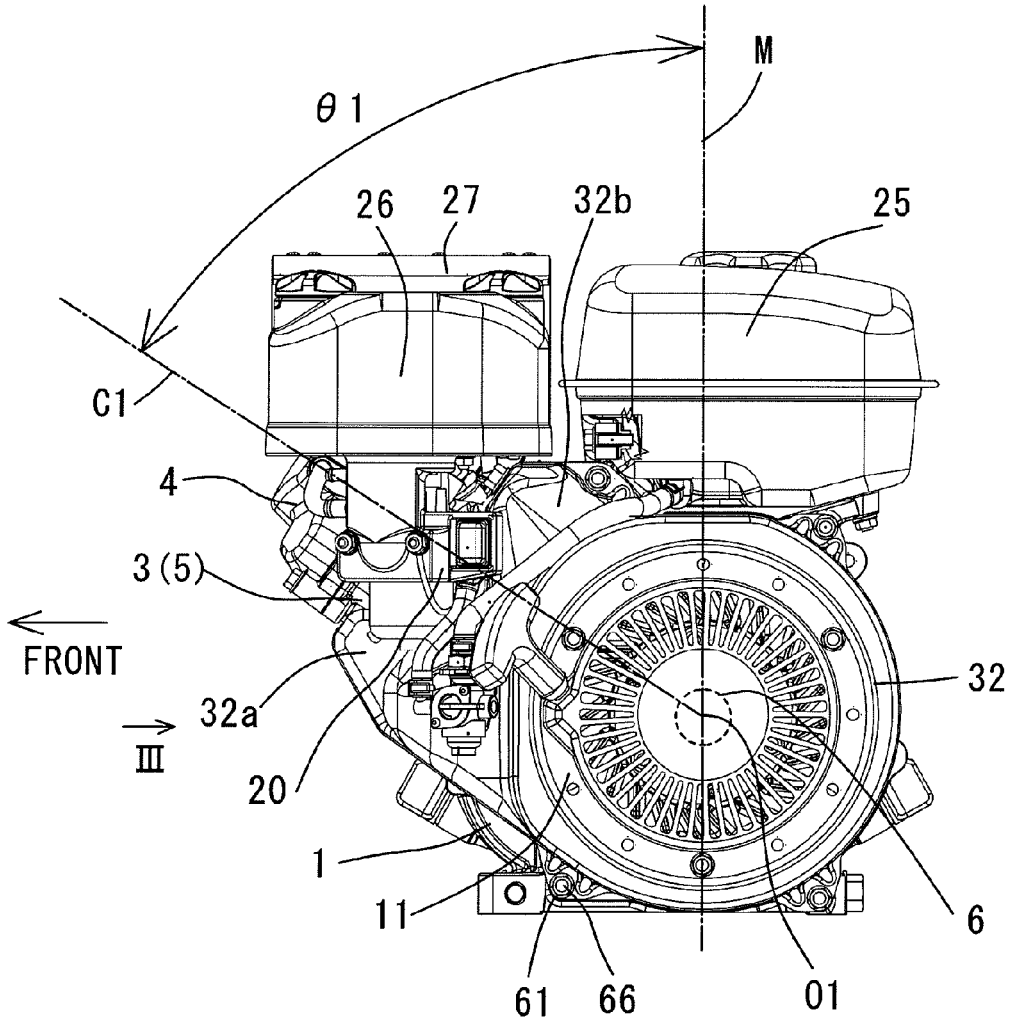
FIG. 1 is a left side view of an air-cooled engine including a cooling apparatus according to an embodiment of the present invention.
Figure 2:
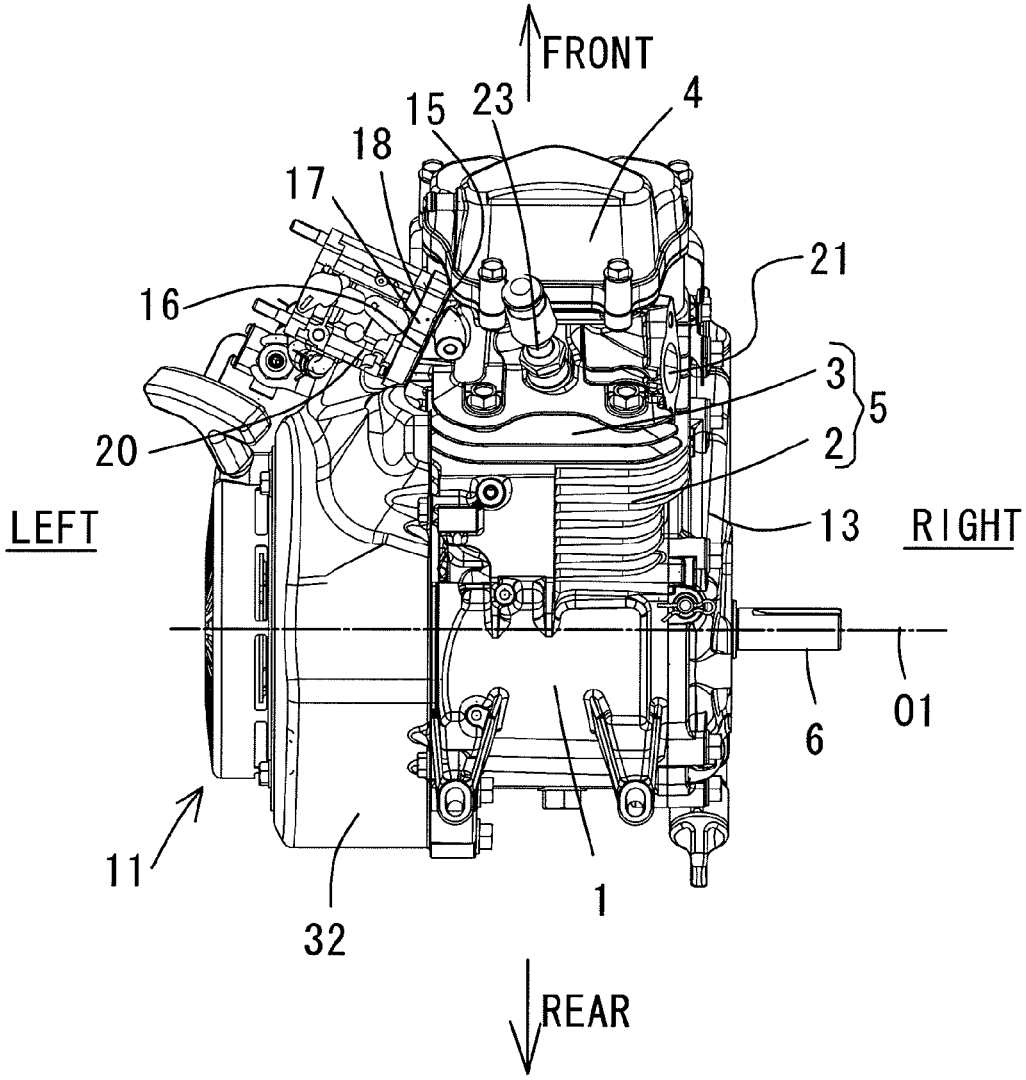
FIG. 2 is a plan view of the engine of FIG. 1.
Figure 3:
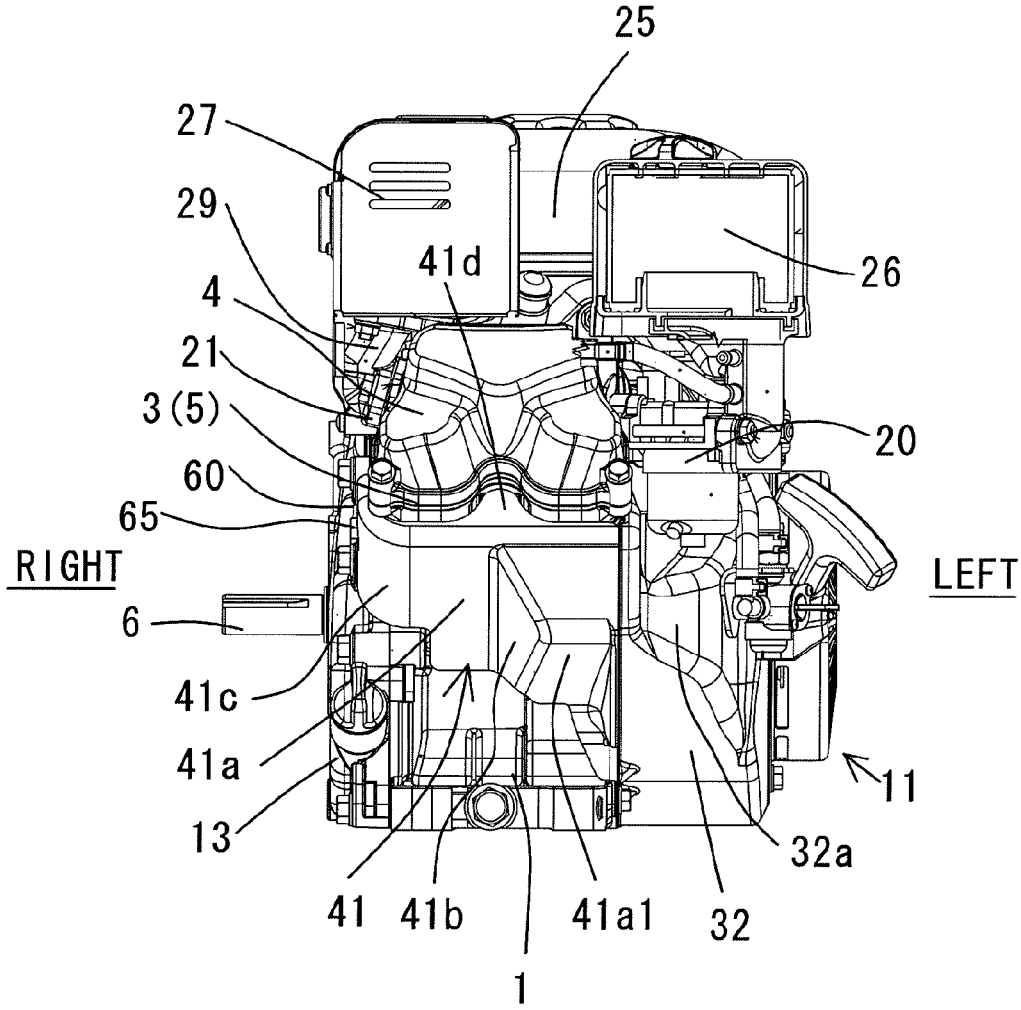
FIG. 3 is a front view of the engine of FIG. 1.

FIG. 1 is a side view of the cylinder inclination type engine seen in the axial direction of a crankshaft (left side view), FIG. 2 is a plan view of the state of detaching a fuel tank, and FIG. 3 is a diagram seen in the direction of an arrow III of FIG. 1 (front view). For convenience in the description, as in FIG. 1, in the horizontal direction substantially orthogonal to a substantially horizontal crankshaft 6, the direction in which a cylinder centerline C1 is inclined is the "front" of the engine, and the axial direction of the crankshaft 6 seen from the rear of the engine is the "left and right direction" of the engine.

In FIG. 2, a cylinder 2 is integrally formed with a crankcase 1 on the upper surface of the front half portion of the crankcase 1, a cylinder head 3 is fastened to the front upper surface of the cylinder 2, and a cylinder head cover 4 is fastened to the front upper surface of the cylinder head 3. In this embodiment, the cylinder 2 and the cylinder head 3 surrounding a cylinder bore will be generically called an engine body portion 5.

A fan housing 32 is attached to the left side surface of the crankcase 1, and a recoil starter 11 is provided on the left side of the fan housing 32. A crankcase cover 13 is provided on the right side of the crankcase 1. The right end of the crankshaft 6 projects from the crankcase cover 13, the right end being a power taking-out portion (crankshaft 6).

An intake port 15 is formed on the left side surface of the cylinder head 3, and a carburetor 20 is connected to a connecting surface (attaching surface) formed along the peripheral edge of the intake port 15 via a first gasket 16, an insulator for heat insulation 17, and a second gasket 18. An exhaust port 21 is formed on the right side surface of the cylinder head 3. In addition, an ignition plug 23 is attached to the substantially center of the left and right width of the cylinder head 3 in the rear half portion on the upper surface of the cylinder head 3.

In FIG. 1, as described above, the cylinder centerline C1 is inclined forward with respect to a vertical line M by a fixed angle θ1 (e.g., 55° to 60°). A fuel tank 25 is arranged on the upper side of the rear half portion of the crankcase 1, and an air cleaner case 26 and an exhaust muffler 27 are arranged on the upper side of the cylinder head 3, the cylinder head cover 4, and the carburetor 20. The air cleaner case 26 is connected to the suction inlet of the carburetor 20.

In FIG. 3, the air cleaner case 26 is arranged on the left side with respect to the center of the left and right width of the engine, the exhaust muffler 27 is arranged on the right side with respect to the center of the left and right width of the engine, and the exhaust muffler 27 is connected to the exhaust port 21 via an exhaust pipe 29.

[Configuration of Cooling Apparatus]

Figure 4:
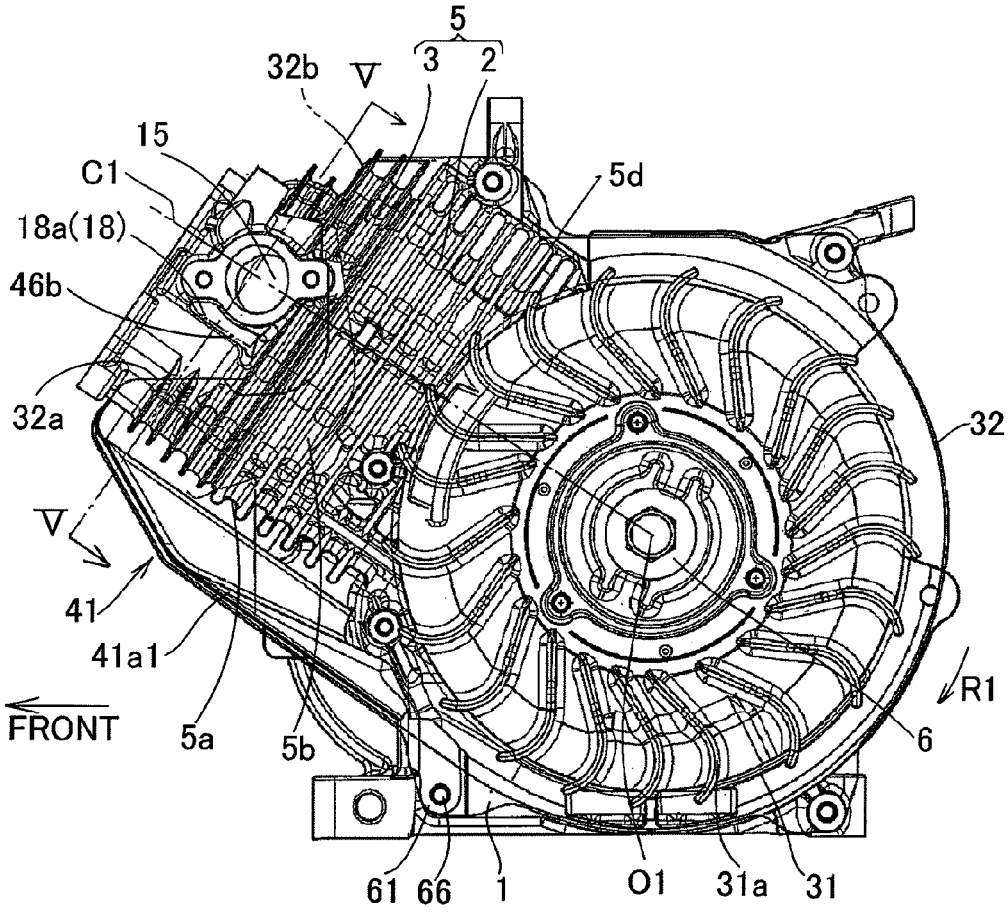
FIG. 4 is a left side view of FIG. 1 from which a recoil starter and a fan housing are detached.
Figure 5:
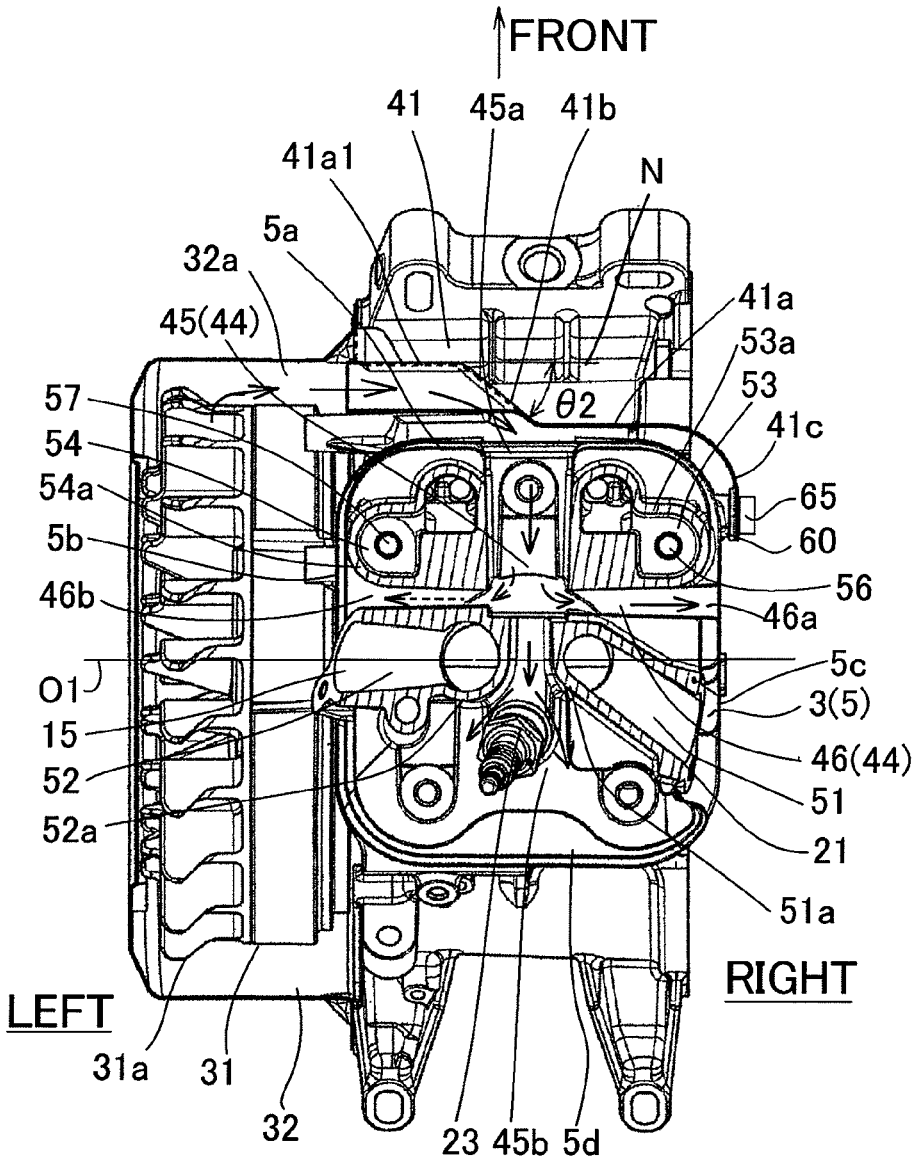
FIG. 5 is a cross-sectional view taken along line V-V of FIG. 4.

FIG. 4 is a left side view of the engine from which the fan housing 32 (imaginary line) is detached, and FIG. 5 is a cross-sectional view taken along line V-V of FIG. 4. In FIG. 5, a cooling apparatus of the engine includes the fan housing 32, a cooling fan 31 housed in the fan housing 32, a shroud 41 covering part of the outer circumferential side surface of the engine body portion 5, specifically, part of a front surface 5*a* and a right side surface 5*c*, and a cooling air passage 44 formed in the cylinder head 3.

In FIG. 4, the cooling fan (impellor) 31 includes a large number of centrifugal vanes 31*a* spaced from each other in the circumferential direction, and is fixed to the left end of the crankshaft 6 to rotate in the direction indicated by an arrow R1. The fan housing 32 is formed to be substantially circular about an axis O1 of the crankshaft 6, a first cooling air outlet 32*a* (imaginary line) projecting forward and upward is formed at the front end of the fan housing 32, and a second cooling air outlet 32*b* (imaginary line) projecting substantially upward is formed on the upper side of the first cooling air outlet 32*a*.

The first cooling air outlet 32*a* projects forward and upward so as to deliver cooling air from the front half portion of a left side surface 5*b* of the engine body portion 5 (the cylinder 2 and the cylinder head 3) to the front surface 5*a* of the engine body portion 5. The second cooling air outlet 32*b* projects substantially upward so as to deliver the cooling air from the rear half portion of the left side surface 5*b* of the engine body portion 5 (the cylinder 2 and the cylinder head 3) to a rear surface 5*d* of the engine body portion 5.

Returning to FIG. 5, the cooling air passage 44 formed in the cylinder head 3 is formed in a substantially cross shape by a first cooling air passage 45 which is substantially straight and is substantially orthogonal to the axial direction (axial line O1) of the crankshaft 6 and the cylinder centerline C1, and a second cooling air passage 46 which is substantially straight, is substantially orthogonal to the cylinder centerline C1, and is substantially parallel to the axial direction (axial line O1) of the crankshaft 6.

The first cooling air passage 45 has an inlet opening 45*a* opened in the front surface of the cylinder head 3 (the front surface 5*a* of the engine body portion 5). The first cooling air passage 45 extends rearward from the inlet opening 45*a*, passes through between a forming wall 53*a* of a push rod insertion hole for exhaust valve 53 and a forming wall 54*a* of a push rod insertion hole for suction valve 54, and passes through between a forming wall 51*a* of an exhaust passage 51 and a forming wall 52*a* of an intake passage 52. The first cooling air passage 45 has an outlet opening 45*b* opened rearward in the vicinity of the ignition plug 23. A push rod for exhaust valve 56 is arranged in the push rod insertion hole for exhaust valve 53, and a push rod for exhaust valve 57 is arranged in the push rod insertion hole for suction valve 54.

In the second cooling air passage 46, a passage portion extending rightward from the crossing portion of the first cooling air passage 45 and the second cooling air passage 46 passes through between the forming wall 51*a* of the exhaust passage 51 and the forming wall 53*a* of the push rod insertion hole for exhaust valve 53, and an outlet opening 46*a* is opened in the right side surface 5*c* of the engine body portion 5. Further, a passage portion extending leftward from the crossing portion of the first cooling air passage 45 and the second cooling air passage 46 passes through between the forming wall 52*a* of the suction passage 52 and the forming wall 54*a* of the push rod insertion hole for suction valve 54, and an outlet opening 46*b* is opened in the left side surface 5*b* of the engine body portion 5.

Figure 8:
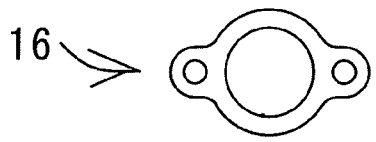
FIG. 8 is a front view of a gasket arranged at the inlet of an intake passage of the engine of FIG. 1.
Figure 9:
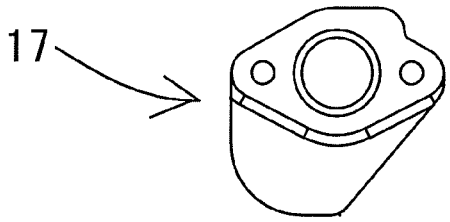
FIG. 9 is a front view of an insulator arranged at the inlet of a intake passage of the engine of FIG. 1.
Figure 10:
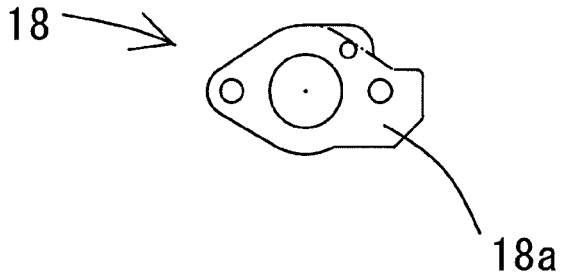
FIG. 10 is a front view of the gasket arranged between the insulator and a carburetor.

FIG. 8 shows the first gasket 16 on the intake port side for connecting the carburetor, FIG. 9 shows the insulator 17 for heat insulating the carburetor, and FIG. 10 shows the second gasket 18 on the carburetor side for connecting the carburetor. The shape of the first gasket 16 shown in FIG. 8 corresponds to the shape of the connecting surface (attaching surface) along the peripheral edge of the intake port 15 shown in FIG. 4. The second gasket 18 shown in FIG. 10 has the same shape as the first gasket 16 of FIG. 8, and is integrally formed with an extending portion 18*a* extending outward in the diameter direction. The extending portion 18*a* of the second gasket 18 extends so as to cover the outlet opening 46*b* on the intake passage 52 side (left side) of the second cooling air passage 46 shown in FIG. 5, which limits the amount of the cooling air which attempts to be relieved leftward from the outlet opening 46*b* on the left side, whereby the cooling air is hard to be relieved leftward. In addition, the insulator 17 also limits the relief amount of the cooling air.

Figure 6:
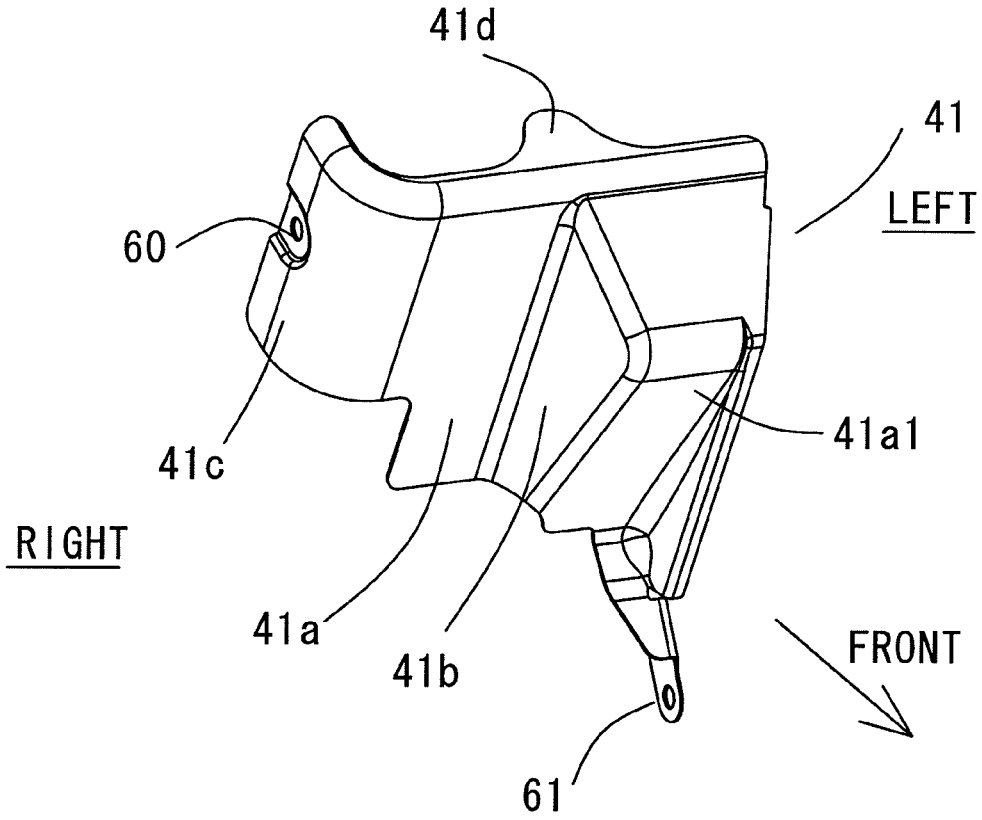
FIG. 6 is a perspective view of a shroud of the engine of FIG. 1 seen from the front, right, and top.
Figure 7:
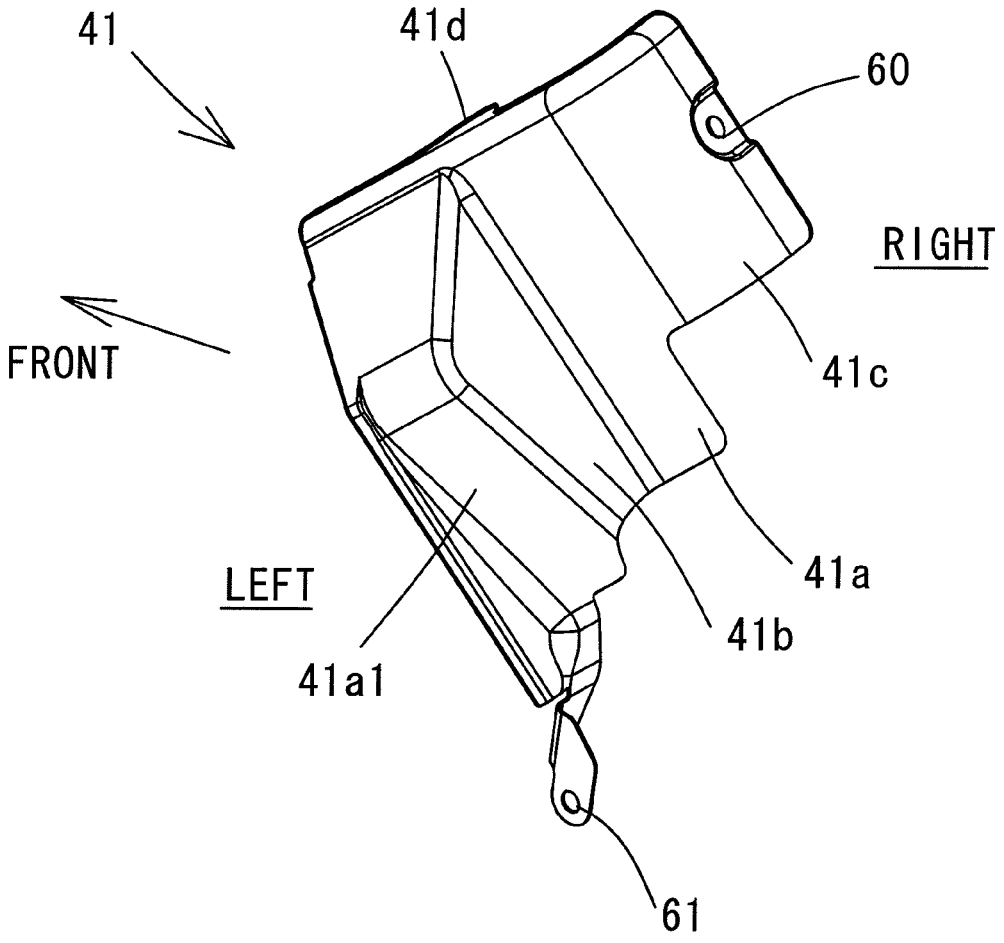
FIG. 7 is a perspective view of the shroud of the engine of FIG. 1 seen from the rear, left, and top.

FIG. 6 is a perspective view of the shroud 41 seen from the right, front, and top, and FIG. 7 is a perspective view of the shroud 41 seen from the left, rear, and top. In FIGS. 6 and 7, the shroud 41 integrally includes a front wall portion 41*a*, a right wall portion 41*c*, and an upper end cover portion 41*d*. A bulging portion 41*a*1 bulging forward is formed in the substantially left half portion of the front wall portion 41*a*, and a narrowed or throttle guide portion 41*b* which has an inclined surface shape and couples the bulging portion 41*a*1 and the right half portion of the front wall 41*a* is formed at the right end of the bulging portion 41*a*1. In addition, the substantially intermediate portion in the up and down direction of the right wall portion 41*c* and the front lower end of the bulging portion 41*a*1 are integrally formed with attached portions 60 and 61 to the engine body portion 5, each having attached holes, respectively.

In FIG. 5, the front wall portion 41*a* of the shroud 41 covers the front surface 5*a* of the engine body portion 5, but the bulging portion 41*a*1 on the left side projects (bulges) forward from the remaining front wall portion (right half portion) 41*a* with respect to the front surface 5*a* of the engine body portion 5. In addition, the left end of the bulging portion 41*a*1 communicates with the first cooling air outlet portion 32*a* of the fan housing 32.

The narrowed guide portion 41*b* is formed in the position which substantially corresponds to the inlet opening 45*a* at the front end of the first cooling air passage 45, and is inclined rearward so that the right side portion of the narrowed guide portion 41*b* closes to the front surface 5*a* of the engine body portion 5. With this, the cooling air delivered from the fan housing 32 into the bulging portion 41*a*1 is forcefully guided to the inlet opening 45*a* of the first cooling air passage 45, and is supplied into the first cooling air passage 45. An inclination angle θ2 of the narrowed guide portion 41*b*, that is, the inclination angle θ2 with respect to a line N substantially parallel to the axial line O1 of the crankshaft 6, is formed at about 40° to 50° in the embodiment, but can be set to an arbitrary angle of 15° to 90°.

In FIG. 3, the cover portion 41*d* at the upper end of the shroud 41 is formed in a shape corresponding to the shape of the front surface of the cylinder head 3, which prevents the cooling air in the shroud 41 from being relieved upward. In addition, as shown in FIG. 4, the bulging portion 41*a*1 of the front wall portion 41*a* of the shroud 41 is inclined rearward so that the low side of the bulging portion 41*a*1 closes to the front surface 5*a* of the engine body portion 5.

In FIG. 5, the attached portion 60 of the right wall portion 41*c* of the shroud 41 is attached to the right side surface 5*c* of the engine body portion 5 with a bolt 65. In addition, as shown in FIG. 4, the attached portion 61 formed in the bulging portion 41*a*1 of the shroud 41 is attached to the side surface of the crankcase 1 together with the fan housing 32 with a bolt 66.

[Operations]

(1) In FIG. 4, the cooling fan 31 rotates integrally with the crankshaft 6 during the operation of the engine, thereby generating the cooling air.

(2) Part of the cooling air generated in the fan housing 32 cools the front half portion of the left side surface 5*b* of the engine body portion 5 in the first cooling air outlet portion 32*a*, and is delivered into the bulging portion 41*a*1 of the shroud 41. The remaining cooling air generated in the fan housing 32 cools the rear half portion of the left side surface 5*b* of the engine body portion 5 in the second cooling air outlet portion 32*b*, and is delivered to the rear surface 5*d* of the engine body portion 5 to cool the rear surface 5*d* of the engine body portion 5.

(3) In FIG. 5, the cooling air delivered to the bulging portion 41*a*1 of the shroud 41 is compressed by the narrowed guide portion 41*b* in an inclined surface shape, and part of the cooling air flows rightward along the front wall portion (right portion) 41*a* of the shroud 41, passes into the right wall portion 41*c*, and is supplied to the right side surface 5*c* of the engine body portion 5. The remaining cooling air compressed by the narrowed guide portion 41*b* is delivered from the inlet opening 45*a* into the first cooling air passage 45.

The cooling air delivered from the inlet opening 45*a* at the front end into the first cooling air passage 45 passes through between the forming walls 53*a* and 54*a* of the push rod insertion holes 53 and 54 to the crossing portion of the cooling air passages 45 and 46, and most of the cooling air flows rearward while being brought into contact with the forming wall 51*a* of the exhaust passage 51 and the forming wall 52*a* of the suction passage 52, cools the exhaust passage 51 and the intake passage 52, and is supplied to the ignition plug 23.

The cooling air cools the ignition plug 23 and is discharged rearward from the outlet opening 45*b* at the rear end.

(6) In addition, part of the cooling air which has reached the crossing portion of the cooling air passages 45 and 46 flows rightward in the right portion of the second cooling air passage 46 while cooling the forming wall 51*a* of the exhaust passage 51, and is discharged from the outlet opening 46*a* at the right end. On the other hand, in the cooling air which attempts to flow from the crossing portion of the cooling air passages 45 and 46 leftward in the left portion of the second cooling air passage 46, the flow of the cooling air to the left portion of the second cooling air passage 46 is limited because the extending portion 18*a* of the second gasket 18 shown in FIG. 10 extends to the left end of the second cooling air passage 46. That is, the flow of the cooling air to the forming wall 52*a* side of the intake passage 52 is limited. In addition, the insulator 17 itself limits the relief amount of the cooling air together with the second gasket 18.

[Effects of the Embodiment]

(1) In the cooling apparatus of the engine including the cooling fan 31, the fan housing 32, and the shroud 41 which guides the cooling air discharged from the interior of the fan housing 32 to the outer circumferential surface of the engine body portion 5, the cylinder head 3 composing the engine body portion 5 is formed with the cooling air passage 44 passing into the cylinder head 3, and the shroud 41 is formed with the narrowed or throttle guide portion 41*b* which guides the cooling air from the interior of the fan housing 32 to the inlet opening 45*a* of the cooling air passage 44. Whereby, the shroud 41 flows the cooling air along the outer circumferential surface of the engine body portion 5 to cool the engine body portion 5 from the outer circumference thereof. Moreover the cooling air flowing through the cooling air passage 44 in the cylinder head 3 can effectively cool each location in the cylinder head 3.

In addition, the narrowed guide portion 41*b* formed in the shroud 41 can forcefully deliver part of the cooling air into the cooling air passage 44, so that the coolability in each location in the cylinder head 3 can be further improved. In addition, the cooling air passage 44 is formed in the cylinder head 3, so that the weight of the cylinder head 3 can be reduced.

(2) The cooling air flowing in the cooling air passage 44 is brought into contact with the forming wall 51*a* of the exhaust passage 51 which particularly becomes hot in the cylinder head 3, so that the exhaust passage 51 can be effectively cooled.

(3) In addition, the cooling air passage 44 supplies the cooling air flowing through the cooling air passage 44 to the ignition plug 23, so that the ignition plug 23 which is likely to be hot together with the exhaust passage 51 can be cooled locally and efficiently by the cooling air.

(4) The first cooling air passage 45 of the cooling air passage 44 is formed so as to pass through between the forming wall 54*a* of the push rod insertion hole for intake valve 54 and the forming wall 53*a* of the push rod insertion hole for exhaust valve 53, so that the waste space between the forming walls 53*a* and 54*a* can be effectively used as the cooling air passage 44 and that the cooling air passage can be easily formed at the time of casting the cylinder head.

(5) The cooling air passage 44 includes the first cooling air passage 45 and the second cooling air passage 46 which are arranged in a substantially cross shape seen in the cylinder centerline C1 direction, so that the cooling area of the cooling air flowing in the cylinder head 3 is increased to enable the interior of the cylinder head 3 to be cooled over a wide range, thereby improving the coolability in the cylinder head 3, and further weight reduction of the cylinder head 3 can be achieved.

(6) In the cooling air passage 44 formed in a substantially cross shape, the outlet opening 46*b* opened in the same direction as the inlet (intake port 15) of the intake passage 52 is limited in the relief amount of the cooling air by the extending portion 18*a* of one second gasket 18 arranged between the inlet of the intake passage 52 and the carburetor 20, so that the cooling air flowing to the side of intake passage 52 is limited and the amount of the cooling air flowing to the side of the exhaust passage 51 is increased. Namely, since the vicinity of the exhaust passage 51 which is likely to be hot is cooled by the increased cooling air to be increased, the cooling efficiency in the entire cylinder head 3 is improved. In addition, the second gasket 18 serves as a cooling air passage limiting member, so that no new members are required to be provided.

(7) The shroud 41 is formed with the bulging portion 41*a*1 on the upstream side of the flow of the cooling air relative to the narrowed or throttle guide portion 41*b* so as to be largely spaced from the front surface 5*a* of the engine body portion 5, and the narrowed guide portion 41*b* is inclined so as to be close to the outer circumferential surface of the engine body portion 5 toward the inlet opening 45*a* of the cooling air passage 44, so that the cooling air can be forcefully delivered and can efficiently delivered into the cooling air passage 44. In addition, the narrowed guide portion 41*b* can be provided by easy bending processing.

(8) The cover portion 41*d* having a shape corresponding to the shape of the front surface of the cylinder head 3 is integrally formed at the upper end of the shroud 41 to prevent the cooling air from being relieved upward from the interior of the shroud 41, so that the cooling effect of the engine body portion 5 by means of the cooling air and the supply of the cooling air into the cooling air passage can be further improved.

[Other Embodiments]

(1) In the embodiment, as shown in FIGS. 8 and 10, of the two gaskets 16 and 18 sandwiching the insulator 17, the second gasket 18 arranged on the carburetor side is integrally formed with the extending portion 18*a*, and the second gasket 18 and the insulator 17 limit the relief amount of the cooling air from the outlet opening 46*b* at the left end of the second cooling air passage 46. However, the first gasket 16 (FIG. 8) arranged on the intake port side can also be integrally formed with the extending portion in FIG. 10. In addition, the relief amount of the cooling air from the outlet opening 46*b* at the left end of the second cooling air passage 46 can be limited only by the insulator 17.

(2) As a fuel supply apparatus which supplies a fuel to the intake passage, in addition to the carburetor as in the embodiment, the present invention is applicable to an engine including a throttle body having an injector.

(3) The present invention is not limited to the single cylinder inclination type engine, and is applicable to an engine in which a cylinder is formed so that its cylinder centerline is substantially vertical and a multiple cylinder engine.

(4) The shape of the passed cooling air passage is not limited to a substantially cross shape, and can be a simple straight line, an L-shape, and a Y-shape.

(5) In the present invention, various modifications and changes can be made without departing from the spirit and scope of the present invention described in the claims.

What is claimed is:

1. A cooling apparatus of an engine, the cooling apparatus comprising:

an engine body portion including a cylinder and a cylinder head connected to the cylinder, the cylinder head having a front surface, a right side surface, a rear surface, and a left side surface;

a crankshaft extended in a right and left direction;

a cooling fan fixed to one end of the crankshaft;

a fan housing surrounding the cooling fan;

a shroud guiding cooling air discharged from an interior of the fan housing to an outer circumferential surface of the engine body portion;

a cooling air passage formed in a cross-shape in the cylinder head and including a first cooling air passage and a second cooling air passage, the first cooling air passage and the second cooling air passage being included in a same plane that is orthogonal to a center line of the cylinder, wherein the first cooling air passage has an inlet opening in the front surface of the cylinder head; and a narrowed guide portion formed in the shroud, the narrowed guide portion guiding the cooling air to the inlet opening of the first cooling air passage, wherein the second cooling air passage is parallel to the crank shaft and extends from the right side surface to the left side surface of the cylinder head, and the first cooling air passage is orthogonal to the second cooling air passage, wherein the first cooling air passage is orthogonal to the second cooling air passage and the center line of the cylinder, and the first cooling passage extends from the front surface to the rear surface of the cylinder head, and wherein the shroud and the narrowed guide portion guide the cooling air generated in the interior of the fan housing located at a right side or a left side of the engine body portion to the inlet opening of the first cooling passage so as to allow the cooling air to flow in a front-rear direction in the first cooling air passage.

2. The cooling apparatus of claim 1, wherein each of the left surface, the right surface, and the rear surface includes an outlet opening, and wherein the cooling fan and the shroud including the narrowed guide portion are configured to force cooling air into the inlet opening such that the cooling air exits each of the outlet openings.

3. The cooling apparatus of claim 1, wherein the cylinder head includes an exhaust passage defined by a forming wall, and an outer surface of the forming wall forms a portion of the cooling air passage.

4. The cooling apparatus of claim 1, wherein the cylinder head includes an exhaust passage defined by a forming wall, and the cooling air passage passes near the forming wall.

5. The cooling apparatus of claim 1, wherein the cooling air passage supplies the cooling air flowing through the cooling air passage to an ignition plug.

6. The cooling apparatus of claim 1, wherein the cylinder head further comprises two pushrod insertion holes and an exhaust passage, and wherein the first cooling air passage passes between the pushrod insertion holes, and the second cooling air passage passes between one of the pushrod insertion holes and the exhaust passage.

* * * * *